US006953351B2

(12) United States Patent
Fromm et al.

(10) Patent No.: US 6,953,351 B2
(45) Date of Patent: Oct. 11, 2005

(54) HIGH-DENSITY, IMPEDANCE-TUNED CONNECTOR HAVING MODULAR CONSTRUCTION

(75) Inventors: Galen F. Fromm, North Aurora, IL (US); Jay H. Neer, Boca Raton, FL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/601,483

(22) Filed: Jun. 23, 2003

(65) Prior Publication Data

US 2004/0058572 A1 Mar. 25, 2004

Related U.S. Application Data

(60) Provisional application No. 60/390,437, filed on Jun. 21, 2002.

(51) Int. Cl.[7] ..... H01R 4/66
(52) U.S. Cl. ..... 439/101; 439/607
(58) Field of Search ..... 439/101, 108, 439/607, 532, 717, 701, 355

(56) References Cited

U.S. PATENT DOCUMENTS

| | | | | |
|---|---|---|---|---|
| 3,399,374 A | * | 8/1968 | William et al. | 439/355 |
| 4,337,989 A | | 7/1982 | Asick | |
| 4,628,410 A | | 12/1986 | Goodman et al. | |
| 4,678,121 A | | 7/1987 | Douty et al. | |
| 4,790,765 A | | 12/1988 | Ehrenfels et al. | |
| 4,824,383 A | | 4/1989 | Lemke | |
| 4,981,447 A | | 1/1991 | Ichitsubo | |
| 5,018,985 A | | 5/1991 | Moore | |
| 5,046,960 A | | 9/1991 | Fedder | |
| 5,256,085 A | | 10/1993 | Tan et al. | |
| 5,281,169 A | | 1/1994 | Kiat et al. | |
| 5,490,786 A | | 2/1996 | Mosquera et al. | |
| 5,525,067 A | | 6/1996 | Gatti | |
| 5,554,038 A | * | 9/1996 | Morlion et al. | 439/108 |
| 5,725,400 A | | 3/1998 | Morikawa | |
| 5,876,248 A | | 3/1999 | Brunker et al. | |
| 5,895,276 A | | 4/1999 | Rothengerger | |
| 5,954,541 A | | 9/1999 | Ozai et al. | |
| 6,007,352 A | | 12/1999 | Azuma et al. | |

(Continued)

FOREIGN PATENT DOCUMENTS

| | | |
|---|---|---|
| DE | 34 12 7000 A1 | 10/1985 |
| DE | 198 21 868 A1 | 11/1998 |

(Continued)

OTHER PUBLICATIONS

Meeting minutes for VESA Flat Panel Display Interface Committee, Jun. 13, 1996, VESA DOC# FPD 96/43.

(Continued)

*Primary Examiner*—Briggitte R. Hammond
(74) *Attorney, Agent, or Firm*—Thomas D. Paulius

(57) ABSTRACT

A termination structure for mating a cable connector to a circuit board includes a plurality of associated sets of terminals, each terminal set including a pair of differential signal terminals and a ground reference terminal. Each associated set of terminals is arranged in triangular pattern through the connector in order to reduce the impedance through the connector, and the sets are fixed within modules or blocks that are engageable together to form a connector housing. The housing modules permit adjacent associated terminal sets to be easily inverted so that the ground reference terminals of alternating associated terminal sets are located along one row of the connector along with signal terminals of intervening terminal sets, while the ground reference terminals of intervening terminal sets are located along a second row of the connector, along with the signal terminals of alternating associated terminal sets.

19 Claims, 9 Drawing Sheets

U.S. PATENT DOCUMENTS

| | | | | |
|---|---|---|---|---|
| 6,139,371 | A | 10/2000 | Troutman | |
| 6,142,804 | A | 11/2000 | Peloza et al. | |
| 6,164,995 | A | 12/2000 | Peloza | |
| 6,264,501 | B1 | 7/2001 | Hung et al. | |
| 6,280,209 | B1 | 8/2001 | Bassler et al. | |
| 6,332,813 | B1 | 12/2001 | Okabe et al. | |
| 6,350,134 | B1 | 2/2002 | Fogg et al. | |
| 6,371,773 | B1 * | 4/2002 | Crofoot et al. | 439/608 |
| 6,375,517 | B1 | 4/2002 | Okabe et al. | |
| 6,431,882 | B1 | 8/2002 | Noda et al. | |
| 6,454,605 | B1 | 9/2002 | Bassler et al. | |
| 6,457,983 | B1 | 10/2002 | Bassler et al. | |
| 6,540,559 | B1 | 4/2003 | Kemmick et al. | |
| 6,575,789 | B2 | 6/2003 | Bassler et al. | |

FOREIGN PATENT DOCUMENTS

| | | | |
|---|---|---|---|
| EP | 0 486 298 | A1 | 5/1992 |
| EP | 0 529 350 | | 10/1996 |
| EP | 0 766 352 | A2 | 4/1997 |
| EP | 0766352 | A2 | 4/1997 |
| EP | 0 793 297 | A2 | 9/1997 |
| EP | 0 836 247 | | 3/2000 |
| EP | 1 239 552 | | 9/2000 |
| JP | 09-221691 | | 9/1999 |
| WO | WO 89/11169 | | 11/1998 |
| WO | WO 02/101883 | | 2/2002 |
| WO | WO 03/026078 | | 3/2003 |

OTHER PUBLICATIONS

Presentation by Don Chambers of JAE Electronics, Inc. Considerations for Connectors for the VESA Flat Panel Display Interface–2,VESA Doc FPDI 96/39Date believed to be Jun. 13, 1996.

Presentation by JAE Electronics, Inc. I/O Connector for LCD Display FI Series (for Vesa FPDI–2), Vesa Doc#FPDI 91/22, date believed to be Feb. 13, 1997.

International Search Report for International Application No. PCT/US03/19704.

IBM Technical Disclosure Bulletin, vol. 39, No. 08, Aug. 1996, pp. 181–182, Personal Computer Channel Connector XP 000638181.

IBM Technical Disclosure Bulletin, vol. 39, No. 08, Aug. 1996, pp. 181–182 "Personal Computer Channel Connector".

International Search Report in PCT Counterpart Application No. PCT/US03/19704, Oct. 20, 2003.

* cited by examiner

HIGH-DENSITY, IMPEDANCE-TUNED CONNECTOR HAVING MODULAR CONSTRUCTION

REFERENCE TO RELATED APPLICATIONS

This application claims priority from prior U.S. Provisional Patent Application No. 60/390,437, filed Jun. 21, 2002.

BACKGROUND OF THE INVENTION

The present invention relates generally to connectors used in connections with signal cables, especially high-speed signal cables, and printed circuit boards and more particularly to high density connectors of modular construction which have selected impedances.

Many electronic devices rely upon transmission lines to transmit signals between related devices or between peripheral devices and circuit boards of a computer. These transmission lines incorporate signal cables that are capable of high-speed data transmissions.

These signal cables may use one or more twisted pairs of wires that are twisted together along the length of the cable, and each such pair being encircled by an associated grounding shield. One wire of the pair may see a +1.0 volt signal, and the other wire of the pair may see a −1.0 volt signal and thus, these wires are called "differential" pairs, a term that refers to the differential, i.e., opposing and balanced signals they carry. Such a twisted pair construction minimizes or diminishes any induced electrical fields form other electronic devices and thereby eliminates electromagnetic interference.

In order to maintain electrical performance integrity from such a transmission line, or cable, to the circuitry of an associated electronic device, it is desirable to obtain a substantially constant impedance throughout the transmission line and to avoid large discontinuities in the impedance of the transmission line. The difficulty of controlling the impedance of a transmission line connector at a connector mating face is well known because the impedance of a conventional connector typically changes through the connector and across the interface of the two mating connector components, particularly with high-density connectors. Although it is relatively easy to maintain a desired impedance through an electrical transmission line, such as a cable, by maintaining a specific geometry or physical arrangement of the signal conductors and the grounding shield, an impedance change is usually encountered in the area where a cable is mated to a connector. If this impedance change is great, it effects the integrity of the signals transmitted across the transmission line. It is therefore desirable to maintain a desired impedance throughout connector interfaces, including their connection to cables and circuit boards.

As shown in U.S. Pat. No. 6,280,209, issued Aug. 28, 2001, it is known that the impedance of a connector system may be selected, or "tuned" when arranging the ground terminal and a pair of associated differential signal terminals in a triangular orientation to form a triplet arrangement of terminals. However, this structure does not address the issue of how to increase the density of terminals within such a connector.

The present invention is therefore directed to a termination structure for providing improved, high-density connections between cables and connectors that provide a high level of performance and which maintains the electrical characteristics of the cable through the mating interface between the cable and device connector in the termination area.

SUMMARY OF THE INVENTION

Accordingly, it is a general object of the present invention to provide an improved, high-density connector for high-speed data transmission connections in which the impedance discontinuity through the connector is minimized so as to better attempt to match the impedance of the transmission line.

Another object of the present invention is to provide an improved connector for effecting a high-performance connection between a circuit board and an opposing connector terminated to a transmission line, wherein the transmission line includes multiple pairs of differential signal wires, each such pair having an associated ground, the connector having pairs of signal terminals and ground terminals associated therewith arranged in triangular fashions in sets of three terminals to form a triplet or a triad, so as to reduce impedance discontinuities from occurring when the connector is mated to the opposing connector and further, by inverting adjacent triangular associated sets of signal and ground terminals, the connector is given a high density characteristic while maintaining a desired preselected impedance through the connector.

Yet another object of the present invention is to provide a connector for high-density applications wherein the connector has a plurality of terminal triads which are triangular arrangements of two signal and one ground terminals spaced apart from each other so as to enhance coupling among the three terminals, the ground terminals being located at the apex of each triangular arrangement, the connector having at least two such triads, with one triad being inverted with respect to the other triad, the terminals of the connector being supported within a plurality of insulative connector housing segments that form housing modules that may be easily inverted in a widthwise fashion along the mating face of the connector.

A still other object of the present invention is to provide a high-density connector having a housing formed from a dielectric material, the housing having a plurality of cavities disposed therein, each such cavity including a conductive terminal, the housing cavities being arranged in triangular sets within the connector and each such triangular set including a pair of signal terminals and one ground terminal, adjacent triangular sets being inverted with respect to each other, the housing being formed from a plurality of separate housing blocks, each of the housing blocks having a triplet of terminals integrated therewith, the housing blocks being interengageable with each other in a manner so that they are easily inverted with respect to each other and so that they may be used to form connector housings of preselected widths.

A still further object of the present invention is to provide a connector using the aforementioned housing blocks, wherein each of the housing blocks is preferably formed from a dielectric and insulative material, and wherein at least two of the housing blocks may have different dielectric constants, or may have an air gap that separates portions of the housing blocks from each other.

Yet still another object of the present invention is to provide an improved high-density connector with controlled impedance for connecting multi-channel transmission lines to electronic devices, the connector including an electrically insulative housing, a plurality of conductive terminals supported by the housing, the terminals including at least two sets of three distinct terminals, each set defining a distinct signal transmission line, and each terminal set including two differential signal terminals and one associated ground terminal, the three terminals of each set being disposed within the housing at corners of an imaginary triangle and the imaginary triangles of each terminal set being inverted with respect to each other and spaced apart from each other widthwise within the connector housing, each terminal set further being supported within a housing module that is formed of an insulative material, the modules being engageable together to form a composite connector housing, with each of the modules being separated from each other by air gaps.

The present invention accomplishes these objects by virtue of its structure. In a principal aspect of the invention, a connector is provided which has an insulative housing that supports sets of three conductive terminals in a unique pattern of a triplet, with two of the terminals carrying differential signals, and the remaining terminal being a ground terminal that serves as a ground plane or ground return to the pair of differential signal terminals. The connector supports multiple terminal triplets, in an inverted fashion (widthwise along the connector mating face) so that two rows of terminals are defined in the connector housing, the signal terminals of a first triplet are disposed in one row of the connector and the ground terminal of that first triplet is disposed in the other row of the connector, while the signal terminals of an adjacent triplet is disposed in the other row of the connector and the ground terminal of this adjacent triplet is disposed in the one row of the connector. Thus, the signal and ground terminals of all of the terminal triplets are arranged in an inverted fashion along a mating face of the connector.

The arrangement of these terminals in sets of three within the connector permits the impedance to be more effectively controlled throughout the connector, from points of engagement of the connector with either a cable or a circuit board or from mating with an opposing connector.

In this manner, each such triplet of the first connector includes a pair of signal terminals having contact portions that are aligned together in side-by-side order, and which are also spaced apart a predetermined distance from each other. The ground terminal is spaced apart from the two signal terminals in a second row. The width of the ground terminals and their spacings from the signal terminals of each such triplet may be chosen so that the three terminals may have desired electrical characteristics such as capacitance and the like, all of which will affect the impedance of the connector. By this impedance-regulating structure, a greater opportunity is provided to reduce the impedance discontinuity which occurs in a connector without altering the mating positions of the terminals, or the pitch of the differential signal terminals. Hence, the present invention may be aptly characterized as providing a "tunable" terminal arrangement for each differential signal wire pair and associated ground wire arrangement found either in a cable or in other circuits.

In another principal aspect of the present invention, these tunable triplets are provided within the connector housing in an inverted fashion by way of a plurality of "blocks", or "modules", each of which contains a set of three terminals arranged in the aforementioned triangular configuration. Thus, the ground terminals of adjacent terminal triplets lie in different terminal rows of the connector, as do the signal terminals in alternating fashion along the width of the connector. Multiple terminal modules are utilized in the connectors, and other terminals of the connector such as power and reference terminals may be situated in the connector within their own modules and between terminal modules.

These and other objects, features and advantages of the present invention will be clearly understood through a consideration of the following detailed description.

BRIEF DESCRIPTION OF THE DRAWINGS

In the course of the following detailed description, reference will be made to the accompanying drawings wherein like reference numerals identify like parts and in which.

DETAILED DESCRIPTION OF THE PREFERRED EMBODIMENTS

The present invention is directed to an improved connector particularly useful in enhancing the performance of high-speed cables, particularly in input-output ("I/O") applications as well as other type of applications. More specifically, the present invention attempts to impose a measure of mechanical and electrical uniformity on the connector to facilitate its performance, both alone and when combined with an opposing connector.

Many peripheral devices associated with an electronic device, such as a video camera or camcorder, transmit digital signals at various frequencies. Other devices associated with a computer, such as the CPU portion thereof, operate at high speeds for data transmission. High speed cables are used to connect these devices to the CPU or to connect the device and two or more CPUs together. Cables that are used in high speed data transmission applications typically will include differential pairs of signal wires, either as twisted pairs or individual pairs of wires.

One consideration in optimizing high speed data transmissions is signal degradation, which involves crosstalk and signal reflection and another consideration is impedance. Crosstalk and signal reflection in a cable may be easily controlled easy enough in a cable by shielding and the use of differential pairs of signal wires, but these aspects are harder to control in a connector by virtue of the various and diverse materials used in the connector. The physical size of the connector also limits the extent to which the connector and terminal structure may be modified to obtain a particular electrical performance.

Impedance mismatches in a transmission path can cause signal reflection, which often leads to signal losses, cancellation, etc. Accordingly, it is desirable to attempt to keep the impedance consistent over the signal path in order to maintain the integrity of the transmitted signals. It is not complicated to control the impedance of a transmission cable. However, the impedance of the connector to which the cable is terminated and the connector mounted on a circuit board of the device to which the cable connects, is usually not very well controlled insofar as impedance is concerned. It may vary greatly from that of the cable. A mismatch in impedances between these two elements may result in transmission errors, limited bandwidth and the like.

Figure 15:
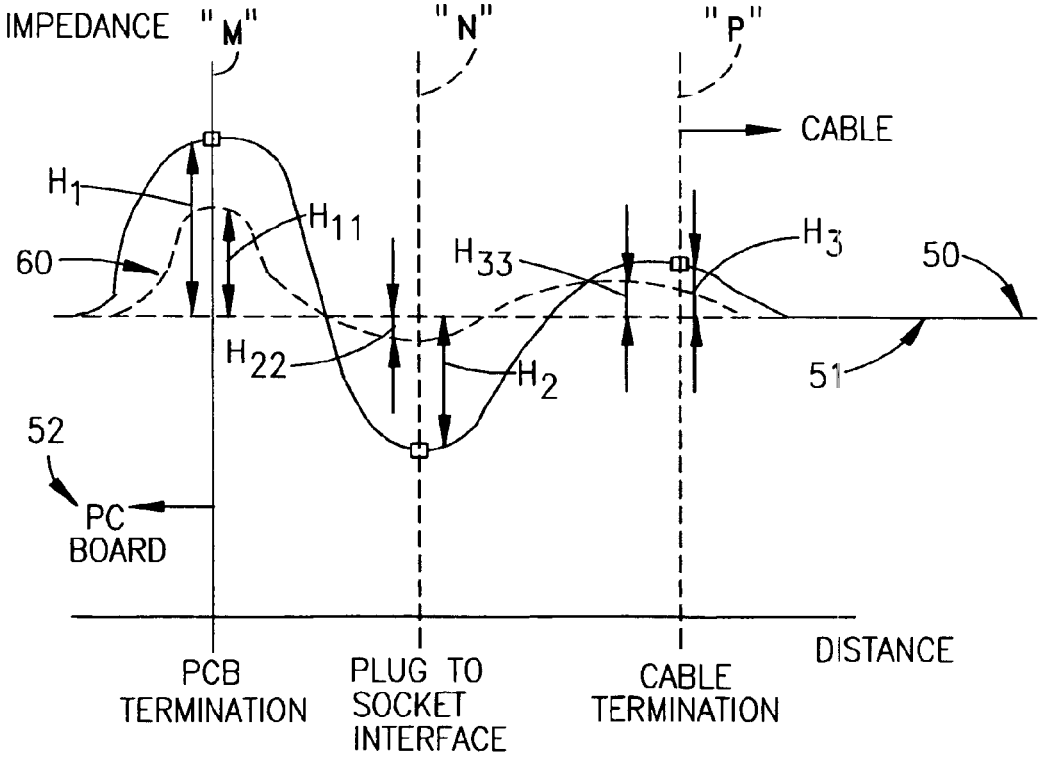
FIG. 15 is a diagram illustrating the typical impedance discontinuity experienced throughout a high-speed cable connection and also the reduction in this discontinuity that would be experienced with the connectors of the present invention.

FIG. 15 illustrates the impedance discontinuity that occurs through a conventional plug and receptacle connector assembly used for signal cables. The impedance through the signal cable approaches a constant, or baseline value, as shown to the right of FIG. 15 at 51. This deviation from the baseline is shown by the solid, bold line at 50. The cable impedance substantially matches the impedance of the circuit board at 52 shown to the left of FIG. 11 and to the left of the "PCB Termination" axis. That vertical axis "M" represents the point of termination between the socket, or receptacle, connector and the printed circuit board, while the vertical axis "N" represents the interface that occurs between the two mating plug and socket connectors, and the vertical axis "P" represents the point where the plug connector is terminated to the cable.

The curve 50 of FIG. 15 represents the typical impedance "variation" or "discontinuity" achieved with conventional connectors and indicates three peaks and valleys that occur, with each such peak or valley having respective distances (or values) $H_1$, $H_2$ and $H_3$ from the baseline as shown. These distances are measured in ohms with the base of the vertical axis that intersects with the horizontal "Distance" axis having a zero (0) ohm value. In these conventional connector assemblies, the high impedance as represented by $H_1$, will typically increase to about 150 ohms, whereas the low impedance as represented by $H_2$ will typically decrease to about 60 ohms. This wide discontinuity between $H_1$ and $H_2$ of about 90 ohms affects the electrical performance of the connectors with respect to the printed circuit board and the cable.

The present invention pertains to a high-density connector that is particularly useful in I/O ("input-output") applications which has a improved structure that permits the impedance of the connector to be set and thereby reduces the aforementioned discontinuity. In effect, connectors of the present invention may be "tuned" through their design to improve the electrical performance of the connector.

Figure 1:
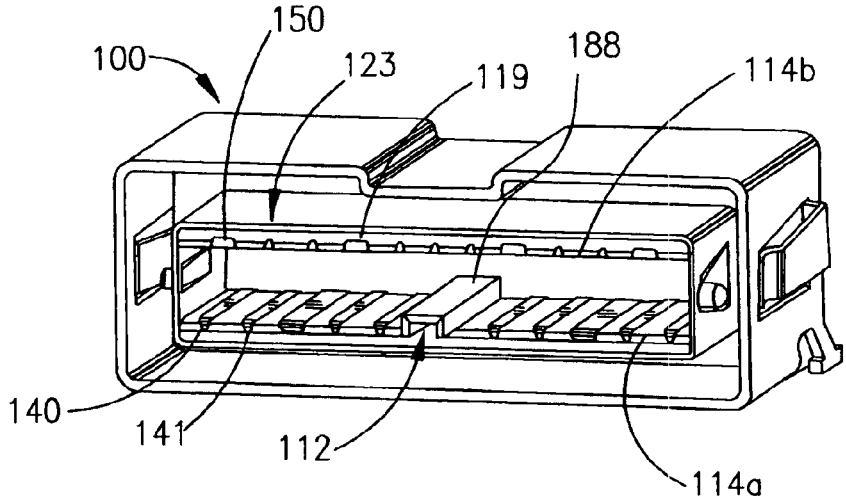
FIG. 1 is a perspective view of a socket, or receptacle, connector constructed in accordance with the principles of the present invention for mounting on a supporting circuit board.
Figure 2:
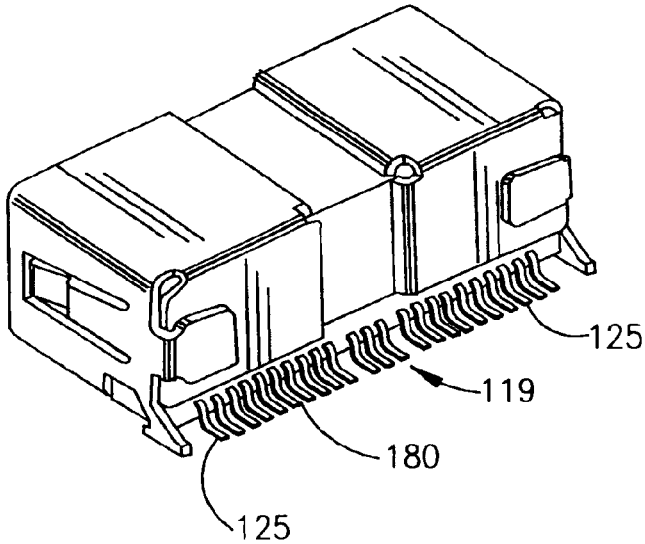
FIG. 2 is a perspective view of the connector of FIG. 1, but illustrating the rear end thereof.

FIG. 1 is a perspective view of a receptacle, or socket connector, 100 constructed in accordance with the principles of the present invention. The connector 100 is seen to include an insulative connector housing 112 that is formed from a dielectric material, typically a plastic. In the embodiment depicted, the connector housing 112 has two leaf, or arm portions 114*a*, 114*b* that extend out from a rear body portion 116 and which form part of a receptacle, or socket, of the connector. These housing leaf portions support a plurality of conductive terminals 119 as shown. The lower leaf portion 114*a* may include a series of grooves, or slots 118 that are disposed therein and are adapted to receive selected ones of the conductive terminals 119 therein. The upper leaf portion 114*b*, likewise includes similar grooves 120 that correspondingly receive the remaining terminals 119 of the connector 110.

Figure 4:
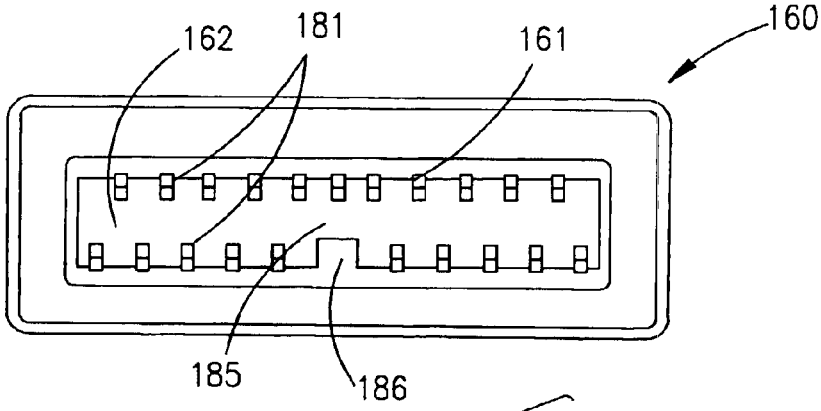
FIG. 4 is a front elevational view of a plug connector that mates with the receptacle connector of FIG. 1.

In order to provide overall shielding to the connector housing 112 and its associated terminals 119, the connector may include a first shell, or shield, 123 that is formed from sheet metal having a body portion 124 that encircles the upper and lower leaf portions 114*a*, 114*b* of the body portion 116. This first shield 123 may also preferably include foot portions 125 for mounting to a surface of a printed circuit board 102 and which provide a connection to a ground on the circuit board, although depending foot portions (not shown) may also be formed with the shield for use in through-hole mounting of the connector 100, although surface mounting applications are preferred. A second shield 126 may also be included that encircles part of the connector housing 112, near the rear portion thereof, and which extends forwardly to encircle the body portion 124 of the first shield 123. This second shield 126 may also utilize mounting feet 127 and utilize a rear flap that may be folded down over the rear of the connector housing 112, and which is secured in place by tabs 129 that are bent rearwardly over it. FIG. 4 illustrates a plug connector 160 that is mateable with the socket/receptacle connector 100 of FIG. 1.

As mentioned earlier, one of the objects of the present invention is to provide a connector having an impedance that more closely resembles that of the system (such as the cable) impedance than is typically found in multi-circuit connectors. The present invention accomplishes this by way of what shall be referred to herein as the arrangement of a plurality of associated terminals that are arranged in distinct corresponding sets, each set being referred to herein as a "triplet" or as a "triad," which in its simplest sense is the arrangement of three distinct terminals. Examples of such triads, or triplets, are illustrated schematically in FIG. 6 wherein the terminals of each distinct set are shown interconnected together by imaginary, dashed lines, and the terminals being arranged at the respective apexes of each such imaginary triangle.

Figure 3:
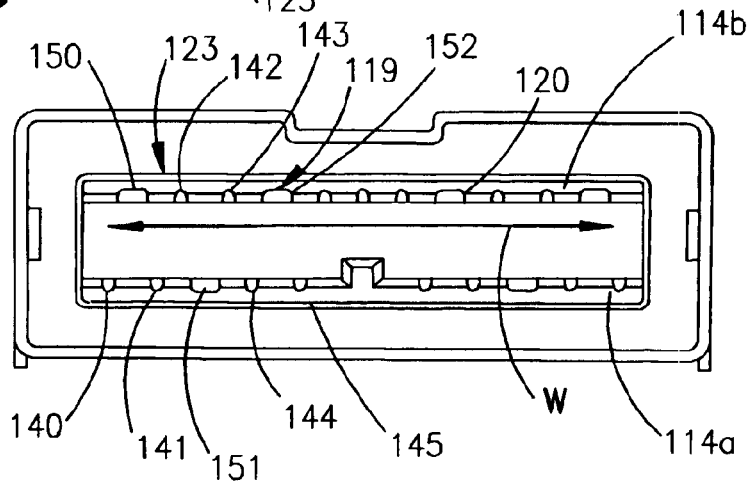
FIG. 3 is a front elevational view of the connector of FIG. 1.
Figure 6:
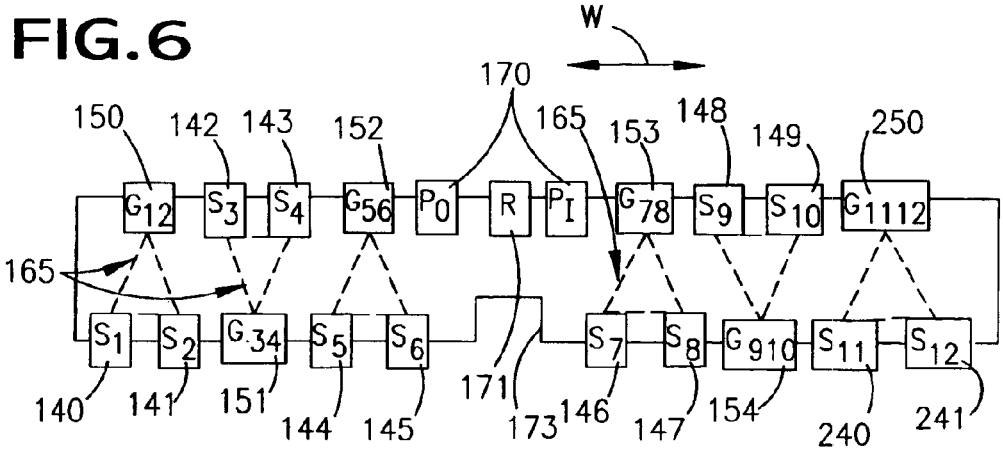
FIG. 6 is a diagrammatic view of the endface of the connector of FIG. 1, illustrating the spatial and inverted arrangement of the multiple associated terminal sets supported thereby.

Each such a triplet involves two signal terminals, such as the two terminals 140, 141 illustrated in FIGS. 1, 3 and 6 and a single ground terminal 150 that are arranged to mate with corresponding terminals 161 of a plug connector 160 held on a plug portion 162 and which are terminated to the wires of a differential pair of wires of a cable (not shown) that carry the same strength signals but which are complements of each other, i.e., +1.0 volts and −1.0 volts. Such a differential pair usually includes a ground reference. The arrangement of associated terminal sets within the connector 100 is shown schematically in FIG. 6. The two signal terminals are spaced apart from each other in a horizontal direction, while the ground terminal is spaced apart from the two signal terminals in the vertical direction so as to enhance electrical coupling among the three terminals of each triad. As can be seen in FIG. 6 (shown generally at 165 thereof), each terminal set has its two differential signal terminals and its ground reference terminal arranged in a triangular pattern, wherein each terminal may be considered, in one aspect as defining one apex of an imaginary triangle.

The terminals that comprise each associated set are interconnected in FIG. 6 by dashed lines 165 to form the aforementioned imaginary triangles, and it can be further seen that FIG. 6 illustrates six distinct terminal sets arranged widthwise of the connector, i.e., along the direction W, but in an inverted fashion. The six terminal sets include the following distinct terminals: 140, 141 and 150; 142, 143 and 151; 144, 145 and 152; 146, 147 and 153; 148, 149 and 154; and, 240, 241 and 250. Each such terminal set includes a pair of differential signal terminals, meaning that the terminals are connected to differential signal traces on a circuit board by way of terminal tails 180, and a single ground reference terminal.

Figure 5:
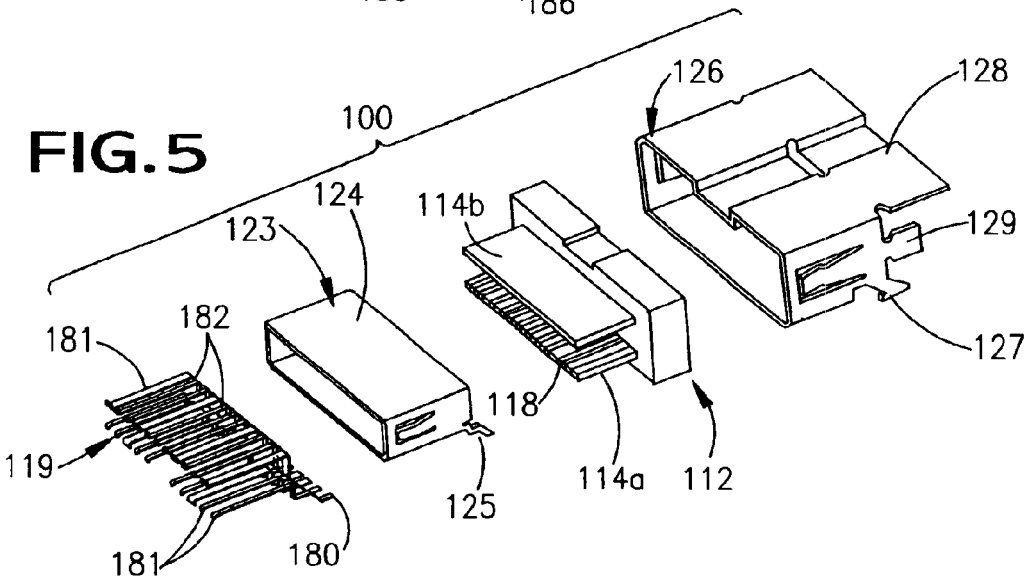
FIG. 5 is an exploded view of the connector of FIG. 1.

Using FIG. 5 as an example, the terminals all preferably each include a flat blade portion 181 that is used for a sliding contact, or mating, with opposing terminals 161 of the plug connector 160. As shown in FIGS. 1 & 5, the ground terminal 150, 151 of each triad is preferably wider than any single one of the associated signal terminals 140, 141 of the triad, and its width may exceed the combined width of the two signal terminals. The terminals 180 also preferably include body portions 182 interconnecting the contact blade and tail portions 181, 180 together. With this design, the terminals 119 may be easily stamped and formed. The terminals 119 are received within corresponding slots 118 of the lower leaf 114*a* of the housing body portion 112 of the receptacle connector and the free ends of the contact blade portions 181 may be held in openings formed at the ends of the slots 118.

In the plug connector of FIG. 4, the plug connector preferably has a solid plug body portion 185 and the terminals are disposed on opposite surfaces of the plug body portion 185. If desired, the plug body portion 185 may include a keyway that is adapted to receive a positive key 188 of the receptacle connector of FIG. 1. The key and keyway may be interposed between at least a pair of distinct terminal triplet sets, as illustrated.

The benefits of the "triad" aspect will now be discussed with respect to a single associated terminal set, namely the terminal set shown at the left of FIG. 6 and including signal terminal 140, 141 (shown as S1 and S2) and ground terminal 150 (G12). The two signal terminals 140 and 141 may be considered in one sense, as arranged in a triangular fashion with respect to the ground terminal 150. They may also be considered in another sense as "flanking" the ground terminal inasmuch as portions of the signal terminals may extend to a point somewhat exterior of the side edges of the ground terminal 150. The triangular relationship among these three associated terminals may vary and may include equilateral triangular relationships, isosceles triangular relationships, scalene triangular relationships and the like, with the only limitation being the desired width W of the connector 100.

The contact blade portions of the terminals 119 are cantilevered out from their respective body portions and therefore lie in different planes than the intermediate body portions. The contact blade portions of the terminals in the two (top and bottom or upper and lower) rows are spaced apart from each other and also lie in different planes from each other. Preferably the contact blade portions of each row are parallel to each other but it is understood that due to manufacturing tolerances and other manufacturing considerations, the two sets of contact blade portions may not be parallel to each other.

In order to increase the density of the terminals within the connector 100, the associated adjacent terminals sets are "inverted" with respect to one another. This is most clearly shown in the plug connector shown in FIG. 6, where it can be seen that the ground terminals of alternating associated terminal sets, namely terminals 150 (G12), 152 (G56), 153 (G78) and 250 (G1112) lie along, or are supported on, one (the upper) leaf portion 114*b* of the connector housing 112 along with the signal terminals of intervening associated terminal sets, namely terminals 142, 143 (S3 & S4), 148, 149 (S9 & S10). In a similar, but opposite fashion, the signal terminals of the alternating associated terminal sets, namely 140, 141 (S1 & S2), 144, 145 (S5 & S6), 146, 147 (S7 & S8), and 240, 241 (S11 & S12) and the ground terminals of the intervening associated terminals sets, namely 151 (G34) and 154 (G910) lie along, or are supported by the other, or lower, leaf portion 114*a*. Other terminals, such as power in and out terminal 170 and a terminal 171 reserved for other use, may be located on either the upper or lower leaf portion, as illustrated in FIG. 6, which may be considered as a schematic diagram of both the plug connector shown in FIG. 4 and the receptacle connector shown in FIG. 1. A key member 173 may also be formed on one of the leaf portions to provide means for keying to the opposing plug connector 160.

By this structure, each pair of the differential signal terminals of the connector and its associated circuit board circuitry have an individual ground terminal associated with them that extends through the connector, thereby more closely resembling the interconnecting cable from an electrical performance aspect. The same inverted, triangular relationship is maintained in the plug connector 160, and this and the structure of the receptacle connector 100 keeps the signal wires of the cable "seeing" the ground in the same manner throughout the length of the cable and in substantially the same manner through the plug and receptacle connector interface and on to the circuit board.

The presence of an associated, distinct ground terminal with each pair of differential signal terminals importantly imparts capacitive, common mode, coupling between the three associated terminals as a set. This coupling will serve to reduce the impedance in that particular region of the connector and serves to reduce the overall impedance variation through the entire cable to board interface. As such, the present invention obtains an impedance curves that more closely emulates the straight line baseline 50 of the Impedance curve of FIG. 15. The sizes on the terminals and their spacing may be varied to in effect, "tune" the impedance of the connector. The effect of this tunability is explained in FIG. 15, in which a reduction in the overall impedance discontinuity occurring through a cable to circuit board connector assembly. The impedance discontinuity that is expected to occur in the connectors of the present invention is shown by the dashed line 60 of FIG. 15. The solid line of FIG. 15 represents the typical impedance discontinuity that is experienced in the connector system, and by comparing the dashed and solid lines, the magnitudes of the peaks and valleys of this discontinuity, $H_{11}$, $H_{22}$ and $H_{33}$ are greatly reduced. The present invention is believed to significantly reduce the overall discontinuity experienced in a conventional connector assembly. In one application, it is believed that the highest level of discontinuity will be about 135 ohms (at $H_{11}$) while the lowest level of discontinuity will be about 85 ohms (at $H_{22}$). The target baseline impedance of connectors of the invention will typically be may vary from about 28 to about 150 ohms, but will preferably be in the range of between about 100 to about 110 ohms with a tolerance of about +/−5 to +/−25 ohms. It is contemplated therefore that the connectors of the present invention will have a total discontinuity (the difference between $H_{11}$ and $H_{22}$)of about 50 ohms or less, which results in a decrease from the conventional discontinuity of about 90 ohms referred to above of as much as almost 50%. This benefit is believed to originate from the capacitive coupling that occurs among the two differential signal terminals and their associated ground terminal. It will be understood, however, that capacitive coupling is but one aspect that affects the ultimate characteristic impedance of the terminals and the connector supporting them.

In the embodiments shown in FIGS. 1–6, the width of the ground terminal contact blade portions are preferably larger than the corresponding contact blade portions of the signal terminals. In some instances, a portion of the ground terminal may overlie or overlap, a portion of at least one of its associated signal terminals and in other instances, the ground terminal may lie between or abut imaginary lines that extend up from the side edges of the signal terminals. In instances where the ground terminals are larger than their associate signal terminals by virtue of their increased width, they will have more surface area than a signal terminal and hence, increased coupling.

Figure 7:
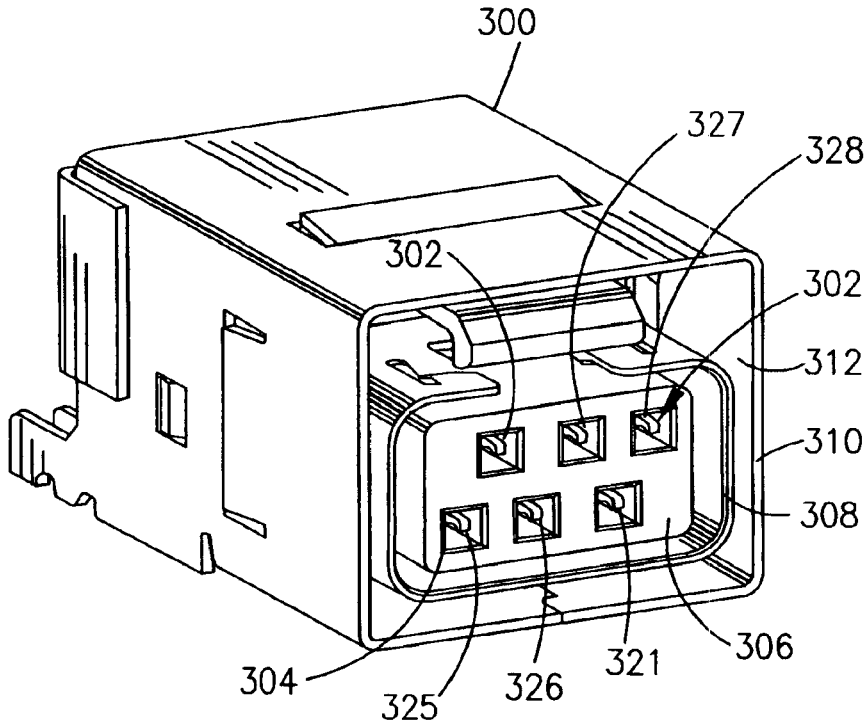
FIG. 7 is a perspective view of another embodiment of a connector constructed in accordance with the principles of the present invention having only two associated signal-ground terminal sets and which utilizes low-force, helix-style terminals rather than flat blade terminals.
Figure 8:
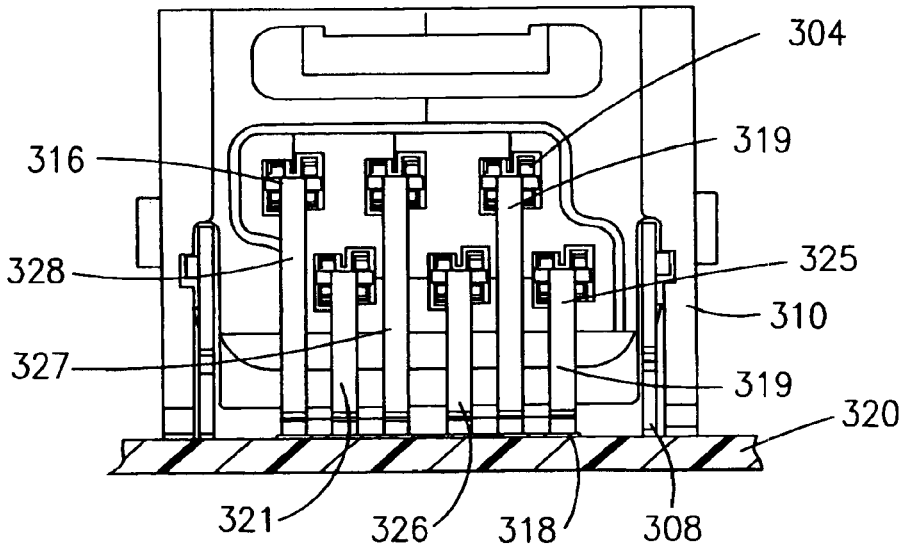
FIG. 8 is a rear elevational view of the connector of FIG. 7.
Figure 11:
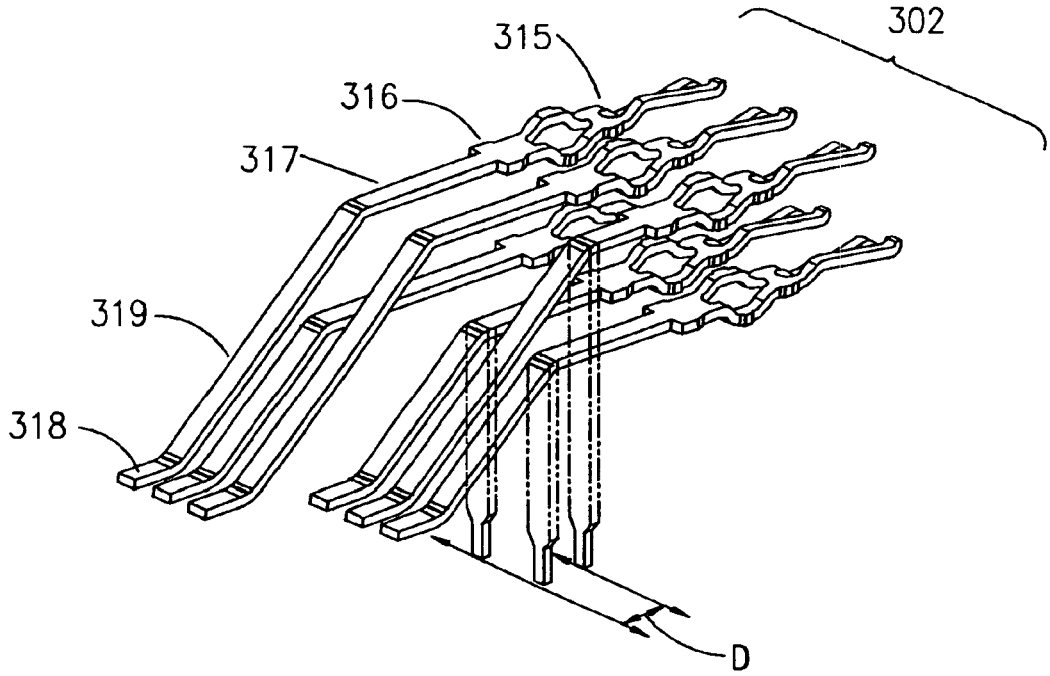
FIG. 11 is a perspective view of a terminal set used in the connector of FIG. 7, illustrating the relative position of and orientation of the terminals to other terminals within their associated terminal sets.

FIG. 7 illustrates another embodiment 300 of a connector incorporating the principles of the present invention and utilizing terminals having pin-type contact portions as opposed to the flat contact blade portion of FIGS. 1–6 In this connector 300, helix-style terminals 302 are utilized and each such terminal 302 is housed within an individual associated cavity 304 of the dielectric connector housing 306. The cavities 304 and their associated terminals 302 are disposed in the connector housing in two rows, as illustrated. The base structure of the contact portions of this type of terminals is described generally in U.S. Pat. No. 4,740,180, issued Apr. 26, 1988. As shown in FIG. 11, each terminal 302 in this style connector 300, has such a helix-style contact portion 315 that extends out from a body portion 316 that is used to hold the terminal 302 in place within its associated connector housing cavity 304, and a tail portion 318 that as shown may be used for mounting the connector 300 to a surface of a circuit board 320. The tail portions 318 of the terminals 302 are connected to the contact and body portions by way of interconnecting portions 319. Although the planes of the contact portions 315 are different (but preferably parallel), the planes of the interconnecting portions 319 and the tail portions 318 are preferably common.

Figure 16:
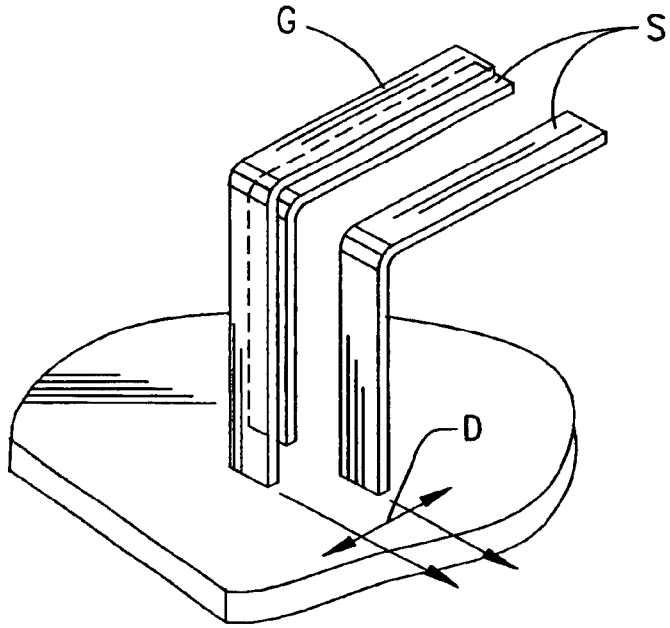
FIG. 16 is a diagrammatic perspective view of a set of terminals of the through-hole style, illustrating how the tail portions and their interconnecting portions need not be in the same plane.

The tail portions 318 of these type terminals are all surface mount tails and, hence lie in a single, common plane that coincides with the top surface of a circuit board (not shown) to which the connector is mounted. However, as illustrated in FIG. 11 (in phantom) and FIG. 16, the terminals may utilize through-hole mounting tails. In this instance, the tails and the body portion of the terminals will not lie in a common plane, but rather, the ground and signal terminals may lie in different planes (vertical planes are shown in FIGS. 11 and 16) and be spaced apart from each other by a spacing "D". In this arrangement, the tails 318 occur as part of the interconnecting body portions 319 and the ground terminal tail is spaced apart from the signal terminal tails.

Figure 9:
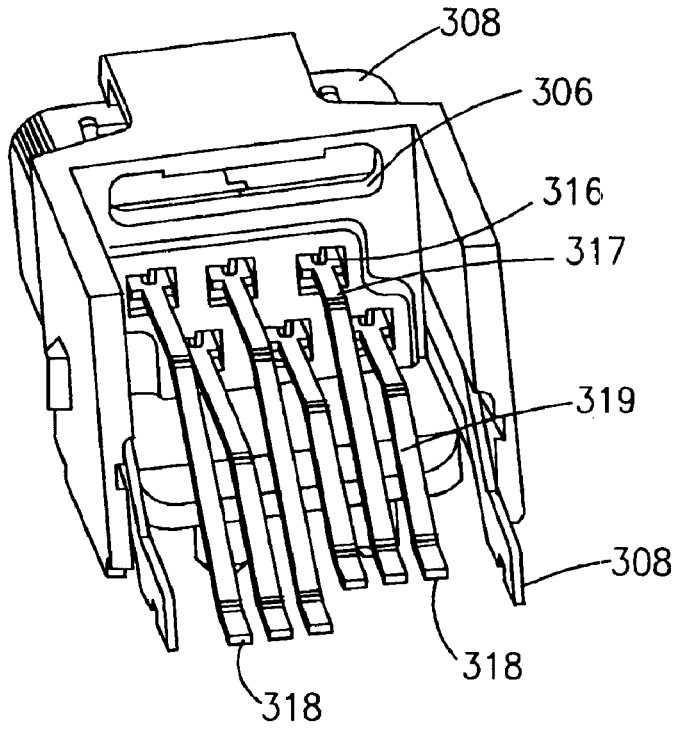
FIG. 9 is a perspective view of the connector of FIG. 7, taken from the rear with its external shell removed for clarity.
Figure 10:
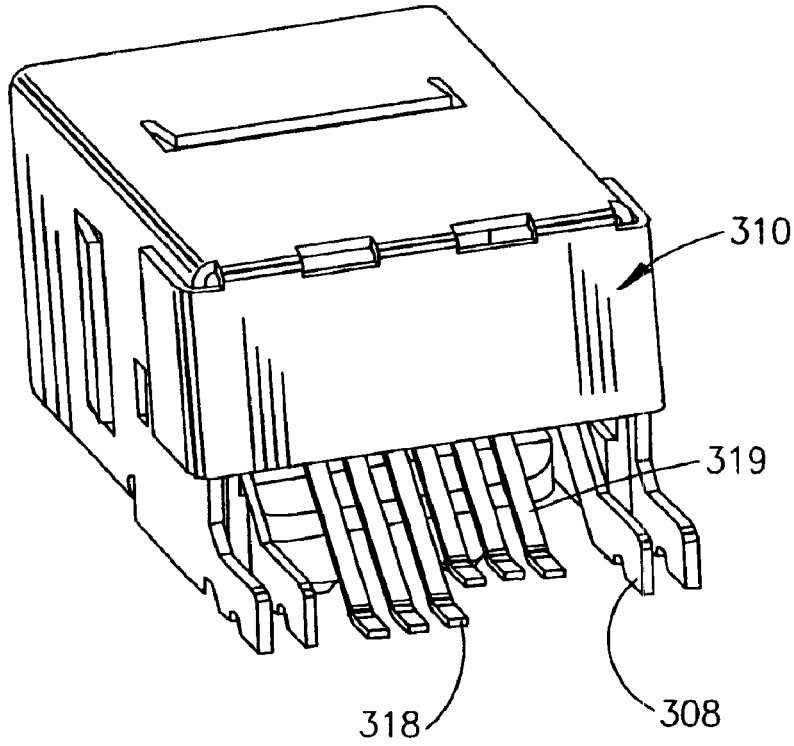
FIG. 10 is a perspective view of the connectors of FIG. 7, taken from the rear but with its external shell applied thereto.

The connector 300 may include a pair of shield, inner shield 308 and an outer shield 310 to provide shielding to the overall connector structure. The inner shield 308 may extend over a portion of the connector housing 306 as shown in FIG. 9, and the outer shield 310 may extend over substantially all of the connector housing 306 in a manner well known in the art. In this embodiment, the connector 300 does not include any ancillary terminals, such as power in and out, or a status detection terminal as might be utilized in the connector of FIGS. 1–6.

In this embodiment, two ground terminals 320, 321 are utilized and are respectively associated each with a pair of differential signal terminals 325, 326 and 327, 328. The signal terminals and ground terminal of each associated set are arranged in the desired triangular fashion and the sets are inverted with respect to each other, meaning that if the connector is considered as having two distinct rows of terminals, the ground terminal 320 of one set is located in one terminal row, while the ground terminal of the other differential terminal set is located in the other terminal row. Likewise, the signal terminals of each differential terminal set are inverted. This type of application is useful on multiple signal channel applications, where each differential terminal set is used to convey data from a different and distinct channel.

Figure 12:
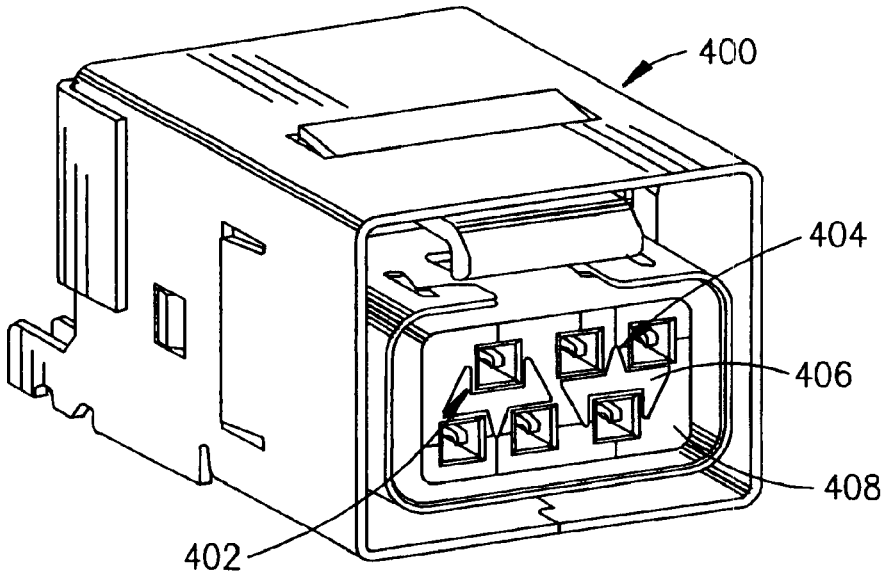
FIG. 12 is a perspective view of another receptacle-style connector constructed in accordance with the principles of the present invention and incorporating recesses within the connector housing to provide a dielectric gap among terminals of each associated terminal set.

FIG. 12 illustrates another embodiment 400 of a connector constructed in accordance with the principles of the present invention. In this embodiment, two sets 402, 404 of differential terminals are illustrated in an inverted triangular fashion, but the three terminals that make up each differential set are partially separated by a recess, or cavity 406 formed in the front face of the connector housing 408. This cavity has a depth less than the depth of the connector housing and may preferably range between about 0.5 mm to about 10 mm. This depth provides a hollow air gap or air "pool" at the mating face of the connector housing and serves to provide a measure of electrical isolation between by modifying the affinity of each of the terminals within a triplet will have for each other. The recess 406 serves to somewhat "tie" the three terminals together by virtue of its use of air as a dielectric. As illustrated, it is preferable that the recess lie within the boundaries of an imaginary triangle connecting the three terminals of the triplet together.

Figure 13:
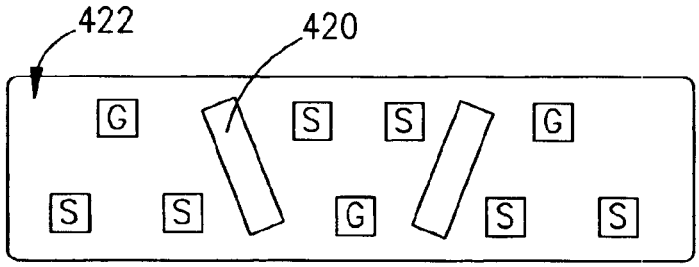
FIG. 13 is a schematic view of another receptacle-style connector diagrammatically illustrating another use of an air, or dielectric gap between associated terminal sets.

FIG. 13 illustrates schematically, how a recess, or cavity, 420 may be formed in a connector housing 422 to isolate differential terminal sets from each other. The recess 420 in this instance may project much deeper into the connector housing than the recess shown in FIG. 12, and may extend, if need be, entirely through the connector housing. In this type of structure, the cavities 420 provide a deep air channel with the air having a different dielectric constant than the connector housing material and thus will serve to electrically isolate terminal triplets from each other.

Figure 14:
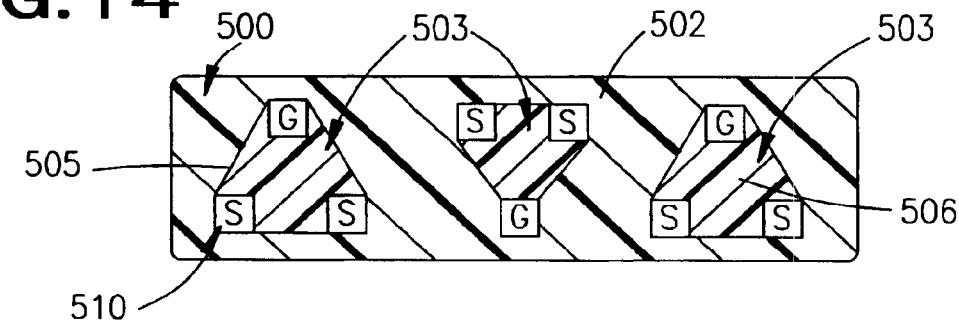
FIG. 14 is a diagrammatic view of another receptacle-style connector constructed in accordance with the principles of the present invention, and illustrating a terminal arrangement wherein each set of associated terminals are previously formed on a dielectric body as an insert that may be inserted into the connector housing.

FIG. 14 illustrates yet another embodiment 500 in which terminal set "inserts" are formed by insert or otherwise molding a set of three associated terminals 510 (including two signal terminals S and one ground reference terminal G) onto a dielectric support 506 that may have the general triangular configuration shown in FIG. 14 to form a distinct insert or module that may be inserted into a corresponding cavity. The terminals of each such associated set are maintained in their triangular orientation by the support 506 so that the two signal terminals are spaced apart from each other and the ground terminal is spaced apart from the signal terminals. These inserts, or modules, are then inserted into the connector housing 502 into complementary shaped cavities 505. In this manner, different dielectric materials are present among the terminals of each associated terminal set as well as between adjacent terminal sets, which are also inverted. The dielectric constant of the molded support 506 will be different than that of the connector housing 502 to provide another means of electrical isolation between terminal triplets and enhance the electrical affinity, at least in terms of coupling, among the terminals of each triplet. In instances where the support material of the terminal set has a dielectric constant higher than that of the surrounding connector housing, the coupling among the terminals in the triplet will be increased, thereby driving the impedance of the triplet down. Conversely, where the support material of the terminal set has a dielectric constant lower than that of the surrounding connector housing, the coupling among the terminals in the triplet will be decreased, thereby driving the impedance of the triplet up. Hence, the impedance of the connector may be tuned, both overall and within individual triplet sets (or signal channels).

Figure 17:
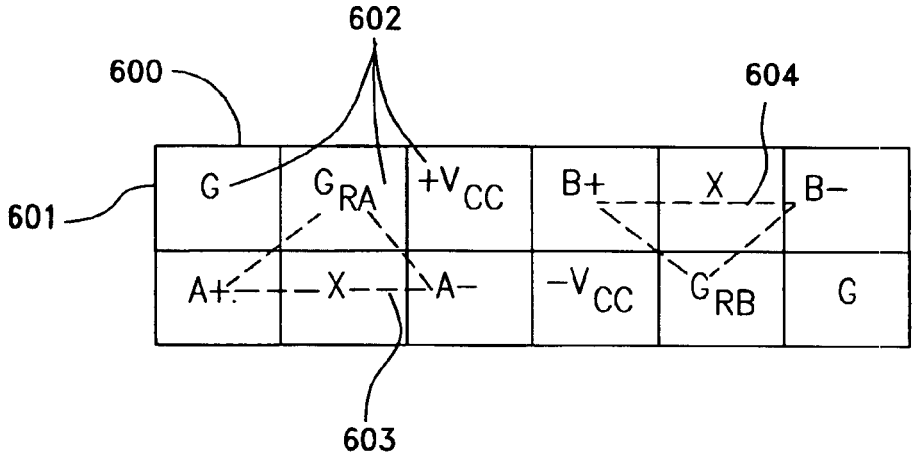
FIG. 17 is a diagrammatic view of an automotive-type connector utilizing the inverted triad structure of the present invention.
Figure 18:
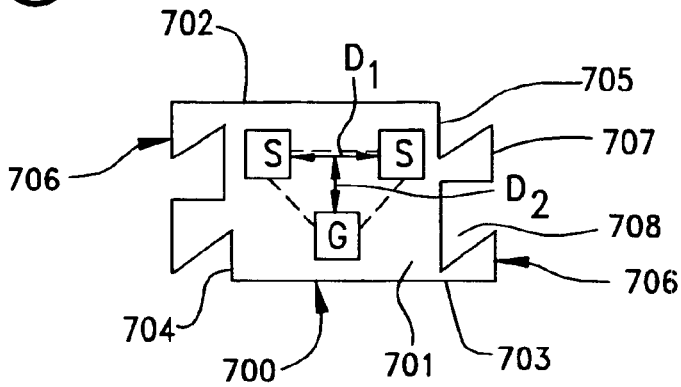
FIG. 18 is a front elevational and diagrammatic view of an individual housing block containing a triplet of terminals for use in differential signal transmission constructed in accordance with the principles of the present invention.
Figure 19:
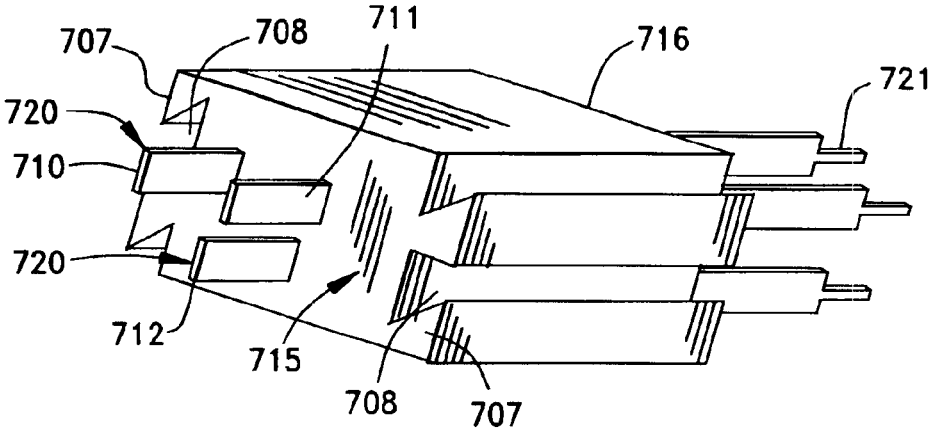
FIG. 19 is a perspective view of a housing block with terminal set integrated therein in accordance with the housing block of FIG. 18.

FIG. 17 illustrates the implementation of the inverted structure of the present invention in a pin-type automotive connector 600. The connector 600 has an insulative housing 601 with a plurality of cavities 602 formed therein. Each such cavity 602 preferably includes a conductive terminal disposed therein, although in some applications, certain of the cavities may be empty or "blind". As shown in the Figure, two signal channels are shown, each of which includes a terminal triplet 603, 604, with two signal terminals A+, A−, B+, B− associated with a single ground terminal GRA and GRB. In this type of application, the terminal triplets or triads may be separated by power "ground" type terminals, i.e., voltage in and voltage return, +Vcc and −Vcc. The terminals extend through to the rear of the housing 601, where they may be terminated to corresponding wires of a wire harness or to a circuit board. The opposing connector will utilize projecting terminals arranged in the same manner to mate with the connector 600.

FIGS. 18–23 illustrate another embodiment of the invention, wherein the connector housing is of a modular construction. As shown diagrammatically in FIG. 18, a connector "block" or "module" 700 is provided having an insulative (and preferably dielectric) body portion 701 that takes the form of a square block having a top surface 702, a bottom surface 703, a left side surface 704 and a right side surface 705. Three conductive terminals 710–712 are arranged within the body portion 701, and preferably are molded in place therein by a suitable process, such as insert molding or over molding. These terminals 710–712 are arranged in two rows, as shown in both FIGS. 18 and 19, with two differential signal terminals 710, 711 (designated S in FIG. 18) forming one of the two rows an a spaced-apart fashion separated by a distance D1. The associated ground terminal 712 (designated G in FIG. 18) forms the second of the two rows and is spaced-apart from the first row in which the signal terminals S lie by a distance D2. As shown by the dotted line in FIG. 18, the three terminals 710–712 are arranged in a triangular configuration, with the terminals arranged at vertices of an imaginary triangle. Preferably, the terminal are maintained in this triangular configuration through the housing block, between the front and rear faces 715, 716 thereof, and such a pattern is readily visible when the blocks are viewed from their front or rear faces 715, 716. The terminals 710–712 extend through the block and have forward contact portions 720 and rear tail portions 721, the tail portions 721 being illustrated in FIG. 19 as through-hole tail portions, although it will be understood that other tail portions, such as surface mount tails 318 of the type illustrated in FIG. 9, may be utilized. The terminals used in this style connector may be pin terminals as shown, or low force helix terminals 315 as shown in FIG. 7, or they may be flat blade portions 140, 141 & 150, as shown FIGS. 1 and 3.

Figure 20:
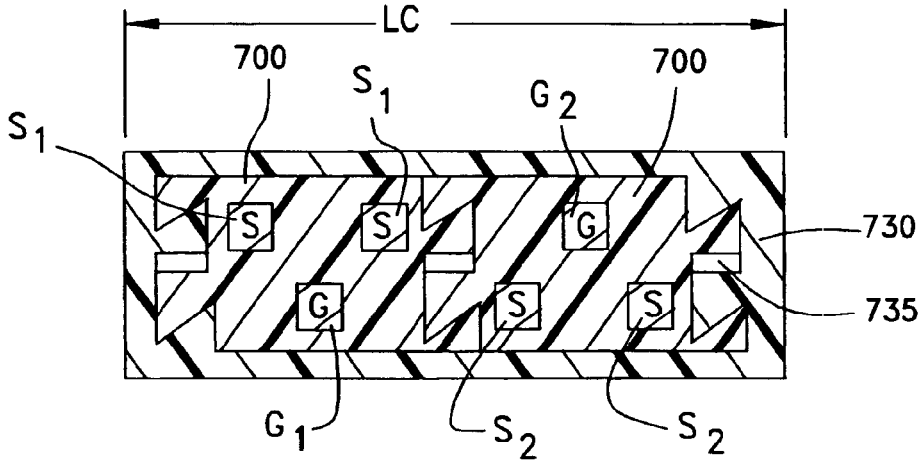
FIG. 20 is a sectional view of a modular connector assembled from two of the housing blocks of FIG. 18 and held together within an exterior carrier member, or shell, and with the housing blocks inverted so that the terminal sets held therein are inverted.
Figure 21:
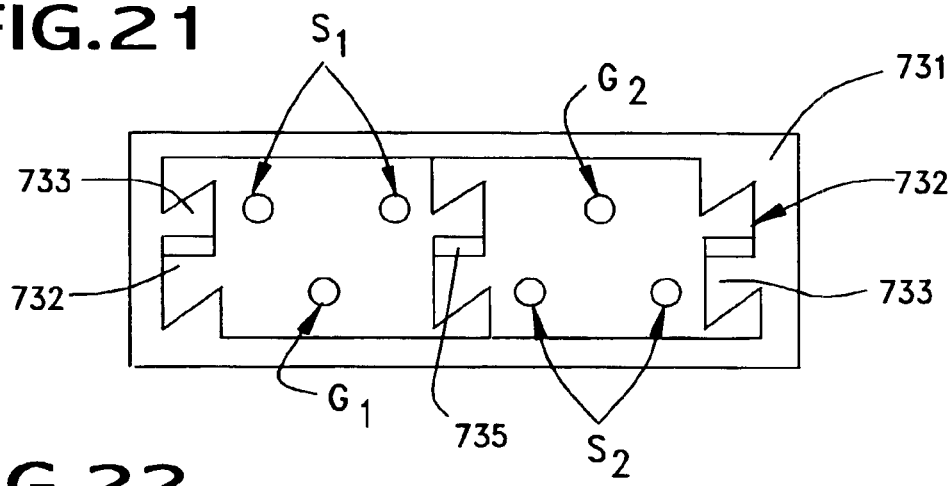
FIG. 21 is a front end view of the modular connector of FIG. 20.

Importantly, the housing blocks 700 are preferably formed with engagement means 706 disposed along their left and right sides 704, 705. In the embodiment of FIGS. 18–21, these engagement means 706 take the form of projections 707 that extend outwardly from the sidewalls 704, 705 of the housing block 700 and notches 708 that separate the projections 707 from each other. These notches 708, or recesses, receive the projections of another housing block, as shown in FIGS. 20 and 21, so that a connector of desired length LC may be easily assembled. In order to hold the connector blocks 700 in place, a carrier member, or outer housing 730 may be provided as illustrated in FIG. 20. Connectors of the invention therefore will have a modular nature. This carrier member 730 also preferably has engagement means 731 in the form of notches 732 and projections 733 that are complementary in shape and spacing to the engagement means 706 of the housing blocks 700. Preferably, the projections take the form of wedge-shaped members which provide an engagement that does not rely upon frictional interference alone. Although the engagement means illustrated in the drawings are shown as mortise and tenon-style engagement members, it will be understood that other styles may be used.

The engagement means 706 formed on the housing blocks 700 may be arranged in such a manner so as to render them complementary when inverted so that they may be readily attached to an adjacent housing block. This is clearly shown in FIGS. 20–21. In those Figures, it can be seen that one housing block is inverted and attached to an adjacent housing block. In this manner, the two housing blocks form two rows of terminals and the terminals are inverted so that the signal terminals of adjacent blocks are inverted, i.e., the two differential signal terminals S1 of the first triplet of terminals are disposed in the first, or upper row illustrated, while the two differential signal terminals S2 of the second triplet of terminals (and housing block) are disposed in the second, or lower row of the connector 700. Likewise, the ground terminals G1, G2 of the two distinct terminal sets lie in different rows. In the arrangement shown in FIGS. 20 and 21, the terminal triplets are arranged in an inverted fashion, while in FIG. 22, they are shown in a non-inverted fashion, wherein the signal terminals S1, S2 of each are disposed in the first (upper) row and the ground terminals G1, G2 are arranged in the second (lower) row.

Figure 22:
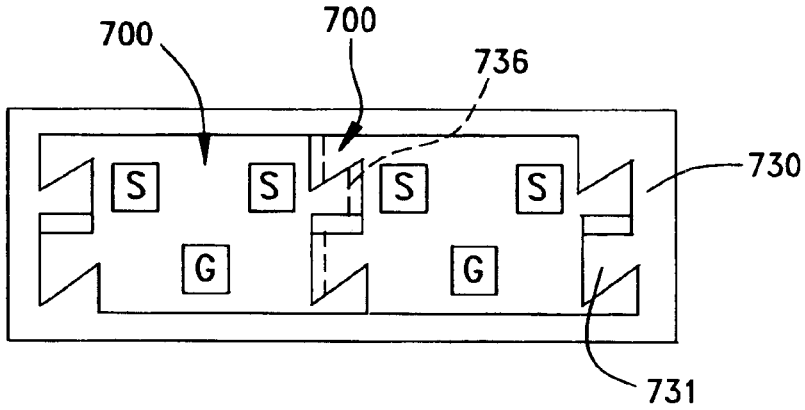
FIG. 22 is a front diagrammatic end view of a modular connector assembled from two housing blocks of FIG. 18, held together within a carrier member, but engaged together in a "straight" fashion; and, FIG. 23 is a perspective view of a plug-style housing block of the invention.

The projections 707 may also be dimensioned slightly smaller than their opposing recesses 708 so as to define an air gap 735, as illustrated in FIGS. 20–22. This air gap 735 is shown arranged horizontally within the connector assembly and it will be understood that the projections of the housing blocks may be reduced in size in a different orientation so as to create vertical air gaps 736, as illustrated by the phantom lines in FIG. 22. Similarly, the structure of the blocks may be modified so that the air gaps 735 are horizontal as shown in FIG. 20. Although the terminals sets may be considered to be electrically isolated in the sense that because of their triangular arrangement, the differential signal terminals of each triplet will exhibit an electrical affinity for each other and for their associated, the air gaps will provide additional isolation between adjacent terminal sets in that the air has a different dielectric constant that the housing material. Similarly, the housing blocks may be formed of materials with different dielectric constants so that one housing block having a low dielectric constant may be flanked on its sides by two housing blocks having a higher dielectric constant. This will affect the coupling among the terminals within each triplet as well as any cross-coupling between adjacent triplets.

Figure 23:
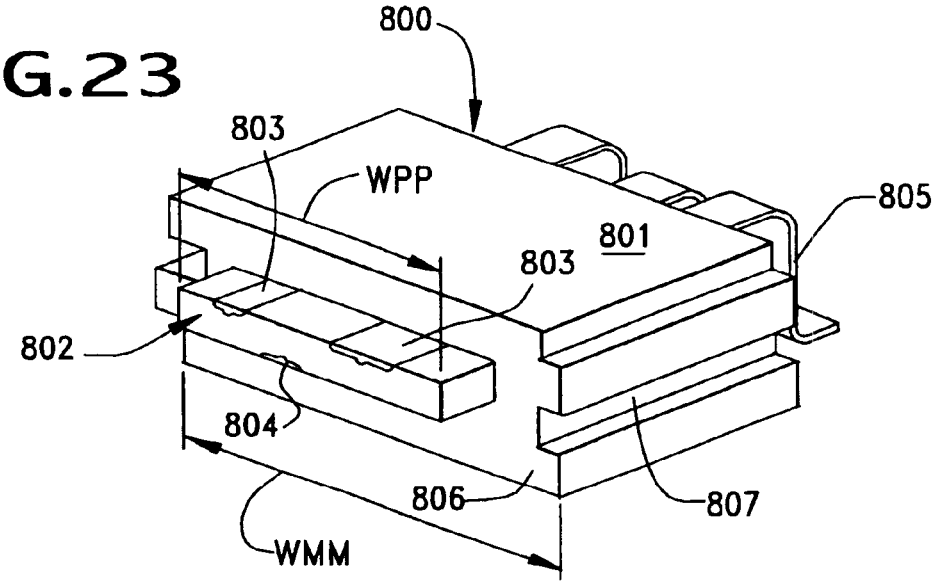

FIG. 23 illustrates another embodiment of a connector housing block 800 that illustrates how the housing blocks of the invention may be used to form plug and receptacle style connectors. The connector module 800 has an insulative body 801, with a projecting plug, or contact blade portion, 802 that extends from the front face of the housing module 800. Flat contact portions of two signal terminals 803 and an associated ground terminal 804 are arranged on opposite surfaces, or sides, of the plug portion 802 for mating with opposing terminals of a mating connector. The plug portion 802 may be formed of the housing module material, preferably a dielectric material, or it may be a separate piece, including a circuit board held by the housing to provide the extending plug portion. The body of the housing module 800 is provided with engagement means in the form of projections 808 and recesses 806. As in the previously described housing modules, the projections are staggered to that they may engage each other in the manner shown in FIGS. 20 and 21 when inverted. The tails 805 of the terminals in this embodiment are surface mount tails and as such they are bent out of the plane in which the contact portions of terminals lie. In order to properly orient the terminals for assembly of an inverted connector, it will be necessary that the tails of the terminals of different housing modules be bent and formed in opposite directions. In other words, the tail portions 805 are illustrated in FIG. 23 as being bent downwardly and in order to provide an inverted construction, the terminal tails portions in each adjacent connector housing should be bent in the opposite direction, i.e., upwardly.

It should be understood that other configurations of the connector housing modules may be utilized, even though they are not shown. For example, a receptacle connector housing block may have a slot or receptacle formed in its front face that supports the terminals, and as illustrated in FIG. 23, the receptacle may have a width less than the width WHM of the housing module and similar to the width WPP of the plug portion 802, so that in any assembled connector, the plug and receptacle portions may be discontinuous along the mating faces of the assembled connectors.

While the preferred embodiments of the invention have been shown and described, it will be apparent to those skilled in the art that changes and modifications may be made therein without departing from the spirit of the invention, the scope of which is defined by the appended claims.

What is claimed is:

1. A high-density electrical connector comprising:

a housing which holds a plurality of conductive terminals, the terminals having contact portions for mating to opposing contact portions of opposing terminals of a mating connector, said terminals including at least first and second distinct sets of terminals, each distinct set of terminals including only a pair of differential signal terminals and an associated ground terminal, said housing being formed from at least first and second interengaging segments, each of the segments supporting only the pair of differential signal terminals and associated ground terminal, the first of said segments supporting only the first distinct set of terminals, and said second of said segments supporting only the second distinct set of terminals; and the two distinct sets of terminals being disposed in at least two rows on said housing, one of the two rows including a pair of differential signal terminals from said first distinct set of terminals and a ground terminal from said second distinct set of terminals, the other of said two rows including a pair of differential signal terminals from said second distinct set of terminals and a ground terminal from said first distinct set of terminals, said first and second distinct sets of terminals being inverted with respect to each other within said housing.

2. The high-density connector of claim 1, further including an exterior carrier member that engages said housing segments and holds them together as a unit.

3. The high-density connector of claim 1, wherein said terminals are arranged in a triangular pattern in each of said housing segments, such that said two differential signal and said associated ground terminals are arranged at vertices of an imaginary triangle and maintain the triangular pattern through said housing segments.

4. The high-density connector of claim 1, wherein said housing first and second segments have different dielectric constants.

5. The high-density connector of claim 1, wherein each of said housing first and second interengaging segments include complementary-shaped projections and recesses.

6. The high-density connector of claim 5, wherein each of said housing first and second interengaging segment complementary-shaped projections and recesses includes mortise and tenon members.

7. The high-density connector of claim 5, wherein said housing first and second interengaging segment complementary-shaped projections and recesses are disposed on opposing sides of said segments.

8. The high-density connector of claim 7, wherein each of said housing first and second interengaging segment complementary-shaped projections and recesses are wedge-shaped.

9. The high-density connector of claim 1, wherein said terminals include contact portions extending from a first face of said housing segments and tail portions extending from a second face of said housing segments.

10. The high-density connector of claim 9, wherein said first and second faces are disposed on opposite sides of said housing segments.

11. The high-density connector of claim 9, wherein, for each of said housing segments, said signal terminal contact portions are spaced apart from each other in a horizontal direction and said ground terminal contact portion is spaced vertically apart from said signal terminal contact portions.

12. The high-density connector of claim 9, wherein said terminal contact portions are arranged in a triangular pattern on said housing segment first faces, whereby said contact portions of said two differential signal and said associated ground terminals are arranged at vertices of an imaginary triangle when viewed from said first faces thereof.

13. The high-density connector of claim 12, wherein said terminal tail portions are arranged in a triangular pattern on said housing segment second faces, whereby said tail portions of said two differential signal and said associated ground terminals are arranged at vertices of an imaginary triangle when viewed from said second faces thereof.

14. The high-density connector of claim 5, wherein said projections and recesses are sized so as to leave air gaps between portions adjacent ones of said interengaging housing segments.

15. The high-density connector of claim 14, wherein the air gaps extend in horizontal directions.

16. The high-density connector of claim 14, wherein said air gaps extend in vertical directions.

17. A high-density electrical connector comprising:

a housing which holds a plurality of conductive terminals, the terminals having contact portions for mating to opposing contact portions of opposing terminals of a mating connector, said terminals including at least first and second distinct sets of terminals, each distinct set of terminals including a pair of differential signal terminals and an associated ground terminal, said housing being formed from at least first and second interengaging segments, the first of said segments supporting said first distinct set of terminals, and said second of said segments supporting said second distinct set of terminals, the housing first and second interengaging segments include complementary-shaped projections and recesses; and the two distinct sets of terminals being disposed in at least two rows on said housing, one of the two rows including a pair of differential signal terminals from said first distinct set of terminals and a ground terminal from said second distinct set of terminals, the other of said two rows including a pair of differential signal terminals from said second distinct set of terminals and a ground terminal from said first distinct set of terminals, said first and second distinct sets of terminals being inverted with respect to each other within said housing and the projections and recesses being sized so as to leave air gaps between portions adjacent ones of said interengaging housing segments.

18. The high-density connector of claim 17 wherein the air gaps extend in horizontal directions.

19. The high-density connector of claim 17 wherein said air gaps extend in vertical directions.

* * * * *